United States Patent [19]

Reinker et al.

[11] Patent Number: 4,481,778

[45] Date of Patent: Nov. 13, 1984

[54] THERMALLY DISCONNECTING PASSIVE PARALLEL ORBITAL SUPPORTS

[75] Inventors: Richard P. Reinker, Arvada; Myron E. Poyer; James M. Lester, both of Boulder, all of Colo.

[73] Assignee: Ball Corporation, Muncie, Ind.

[21] Appl. No.: 477,477

[22] Filed: Mar. 21, 1983

[51] Int. Cl.[3] ..... F17C 1/02

[52] U.S. Cl. ..... 62/45; 220/439; 220/901

[58] Field of Search ..... 62/45, 55, 514 R; 220/437, 439, 901

[56] References Cited

U.S. PATENT DOCUMENTS

| | | | |
|---|---|---|---|
| 3,021,027 | 2/1962 | Claxton | 220/437 |
| 3,069,042 | 12/1962 | Johnston | 62/45 |
| 3,115,983 | 12/1963 | Wissmiller | 220/437 |
| 4,038,832 | 8/1977 | Lutgen et al. | 62/45 |
| 4,300,354 | 11/1981 | Buchs et al. | 62/45 |

*Primary Examiner*—Ronald C. Capossela
*Attorney, Agent, or Firm*—Gilbert E. Alberding

[57] ABSTRACT

A support for a cryogen container, particularly adapted for use in spacecraft, provides a dual support. One portion of the structure supports the container in the absence of acceleration force, and the other portion of the structure supports the container in the presence of acceleration forces. The support includes a first connector means and second connector means. A first support extends between the first and second connector means. The first support is constructed of high-strength metal and is adapted at its ends for structural engagement and support of said first and second connector means. A second support also extends between said first and second connector means. The second support is constructed of material having low thermal conductivity, has a degree of elasticity, and provides support of said first connector means from said second connector means in the presence of normal forces imposed by the container and its contents. The second support is deformable in response to forces significantly in excess of the normal gravitational forces imposed by the container and its contents and permits the structural engagement of the first support with the first and second connection means.

5 Claims, 3 Drawing Figures

THERMALLY DISCONNECTING PASSIVE PARALLEL ORBITAL SUPPORTS

BACKGROUND OF THE INVENTION

This invention relates generally to a system for supporting the inner container of a cryostat, more particularly a system for maintaining the spacing and supporting a cryogen container from surrounding warmer walls with reduced heat loss through the support system.

Cryogenic materials, such as liquefied and solid gases, are frequently stored in cryostats or cryogenic containers for use in orbiting spacecraft. Such cryostats are designed to minimize the transfer of heat from the outer vacuum jacket and environment surrounding the cryostat to the cryogenic material. Notwithstanding cryostat design techniques, cryogenic material is lost in the heat transfer accompanying the imperfections of the insulation, the plumbing, the electrical wiring, and the supporting structure of the cryostat. The heat leak associated with the supporting structure for the inner container of a cryostat can be as much as 60 percent of the total heat transfer loss and, thus, constitute a significant contribution to the loss of cryogenic material from the system and make a significant reduction in the useful life of cryogenic systems of spacecraft.

In the past, orbital cryogenic systems have used fiberglass-epoxy tension band supports within the cryostat for the cryogen container. In such systems, however, the epoxy-fiberglass-tension bands connected directly portions of the cryogen container with the surrounding warmer-walled vacuum jacket. Such systems have provided a significant heat leak between the spacecraft environment and the contained cryogenic material of the system. The container supports must, of course, have sufficient strength to support the container and its contents against the significant loads imposed on the supporting structure by the acceleration accompanying the launch of the spacecraft. During such a launch, the larger forces imposed by the acceleration of the launching rockets must be borne entirely by the cryogen container supports at a time when the container has its greatest mass. Since the prior art tension band supports were designed with sufficient size to carry the forces imposed by the container and its contents during launch, they have provided a significant path for heat transfer to the cryogenic material in the container.

SUMMARY OF THE INVENTION

This invention provides a system to substantially reduce the heat transfer to the cryogenic material through the container-supporting structure and substantially increases the useful life of the stored cryogenic material in orbit. This new and inventive system is attained by using a dual-supporting structure.

In the supporting system of this invention, one portion of the support system is engaged only during, and as a result of, high loads, such as those typical of the accelerations that exist during launching and landing operations. The other portion of the supporting system is engaged at all times. Such a support system includes a pair of connector means, the first such means being adapted for connection with the cryogen container and the second such means adapted for connection with its surrounding environment. A first support extends between the first and second connection means and is constructed of high-strength materials, such as metals, and is adapted at the ends for structural engagement with the first and second connection means. In the absence of acceleration forces, the first support is free from contact with the connection means; and the first support is disengaged from the first and second connector means and is relatively thermally isolated in the presence of the normal forces imposed by only the container and its contents. The second support extends between the first and second connector means and is constructed of material having low thermal conductivity and a degree of elasticity and provides support of the first connection means from the second connection means in the presence of the normal forces imposed by the container and its contents. During the imposition of the acceleration loads accompanying launching, landing, and other rocket energization, the second support deforms in response to such forces, which are significantly in excess of the normal forces imposed upon the support by the container and its contents, and permits the structural engagement of the first support with the first and second connector means to support the container.

In one preferable form of such a system, the first support comprises a rigid member concentrically arranged with the second, more elastic supporting member. The rigid member has high-tensile strength and extends between the first and second connectors within the second more elastic member. The rigid member is adapted at its ends to engage the first and second connectors, which are adapted to be fastened to the cryogen container and surrounding warmer walls (e.g., the vacuum jacket of a cryostat), respectively, and to thereby prevent them from moving apart. The second member extends between the first and second connectors and is maintained in tension between the first and second connectors to thereby maintain the spacing of the container from the surrounding warmer environment in the presence of only gravity and in the absence of forces imposed by acceleration. The length of the concentric rigid first support is such that its ends do not contact the first and second connectors when the spacing of the first and second connectors is being maintained by the second member. The inner rigid member is a high-strength material such as titanium, Inconel, or stainless steel and the second more elastic member is fabricated of a low thermal conductance fiberglass-epoxy in a strap configuration. Such a second member has a modulus of elasticity such that, when exposed to forces in excess of those represented by the container and its contents (such as those accompanying launching or landing operations), the second member will stretch and permit the ends of the rigid member to engage and hold the first and second connectors and thereby support the container in the presence of the forces imposed by high accelerations.

With such a system, the second support or member may be designed to support only the weight of the container and its contents and does not need to be designed for the acceleration forces that occur in operation of the spacecraft. Thus in orbit, when supported only by the second member, the heat loss of the supporting structure may be substantially reduced by the smaller size of this portion of the supporting system.

Other features and advantages will be apparent from the following drawings and description:

DETAILED DESCRIPTION OF THE PREFERRED EMBODIMENTS

Figure 1:
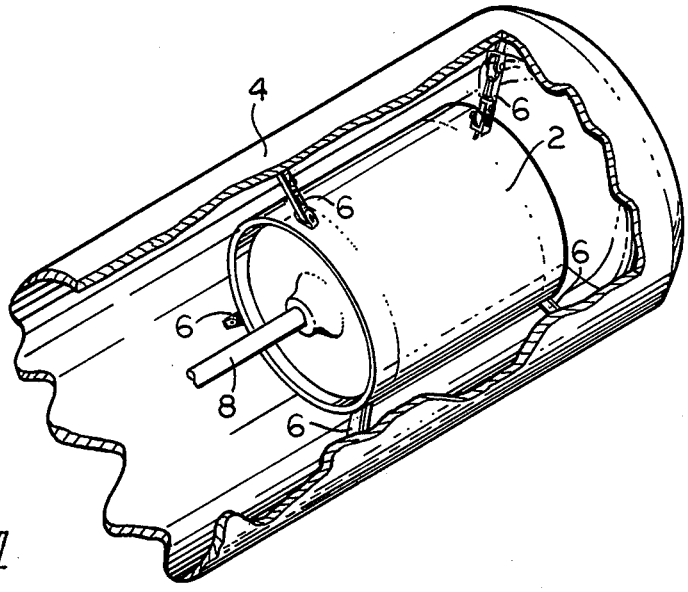
FIG. 1 is a diagrammatic view of the interior of a cryostat broken to show the supporting system of this invention, with one system partially broken away as in FIG. 2.

FIG. 1 shows diagrammatically a cryostat with the invention of this application in use to support the inner container of cryogenic material. As shown in FIG. 1, the inner tank, or cryogen container, 2 is suspended from the vacuum jacket 4 by a plurality of support systems 6 (one shown in a broken view). Cryogen may be removed from the cryostat over insulated hoses 8 connected to the container 2. The number and location of the support systems 6 are designed to hold the cryogen container substantially stationary in the event of acceleration forces from any direction, but most particularly in the presence of the forces of acceleration imposed in launching and in maneuvering and landing the spacecraft, where applicable.

In use, heat is transferred to the cryogenic material within the inner tank 2 from the vacuum jacket 4, through the plurality of supports 6. The support systems used prior to this invention comprised a plurality of fiber glass epoxy straps with connectors at each end to fasten the straps to the inner tank at their one ends and to the vacuum jacket at their other ends. The forces experienced in operations, such as launching, required a support system that presented a substantial wasteful heat loss, and a corresponding loss, therefore, of cryogenic material. The dual supporting structure of this invention provides a strong supporting system with a significantly reduced heat loss.

Figure 2:
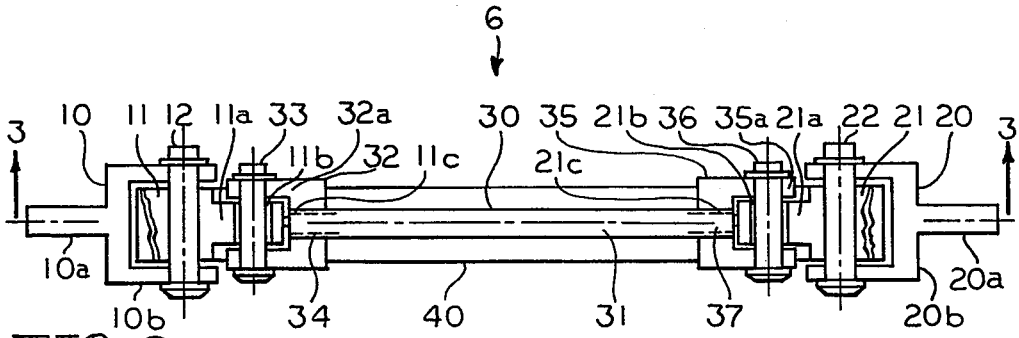
FIG. 2 is plan view of a supporting system of this invention partially broken away to show its interior structure.
Figure 3:
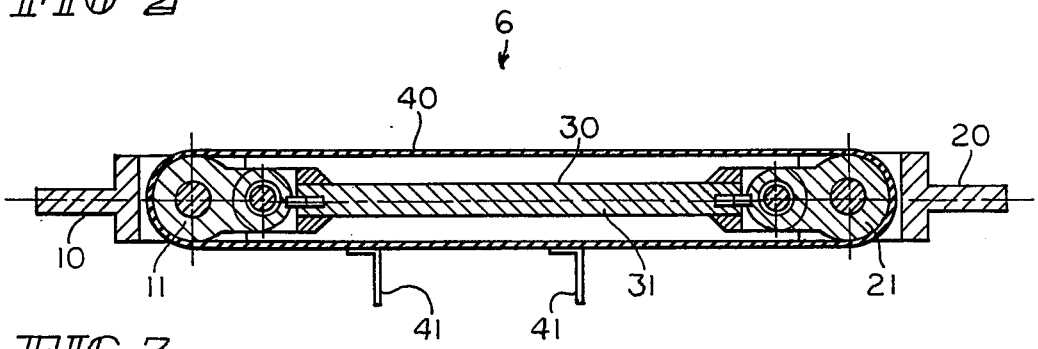
FIG. 3 is a cross-sectional view from the side of the supporting structure of FIG. 2, at a plane through center, lines 3-3, to show its interior structure.

As shown in FIG. 2 and FIG. 3, the system 6 of this invention includes generally a first connector 10, a second connector 20, and a first support 30 concentrically arranged within a second supporting portion 40. The first and second connectors 10, 20 can be substantially identical and can include fastener portions 10*a* and 20*a* that extend into clevis portions 10*b* and 20*b*, respectively. The first and second connectors each include interior links 11 and 21, respectively, carried within the clevis portions 10*b* and 20*b* by clevis pins 12 and 22, respectively. Links 11 and 21 each include a portion 11*a* and 21*a*, respectively, extending outwardly of the clevis portions 10*b* and 20*b* and being adapted for engagement with the first support 30.

As shown in FIG. 2, the extending portions 11*a* and 21*a* of links 11 and 21 are formed with bores 11*b* and 21*b*.

The first support 30 includes a central rod or tube 31 of material having high-tensile strength. Such a rod may be preferably titanium, Inconel, or stainless steel and can be designed with a sufficient cross-sectional area to carry the maximum acceleration loads that may be imposed by the cryogen container and its contents during launching or landing operations. The support 30 is adapted at its ends for engagement with the first connector 10 and the second connector 20. Thus, fastened at the end of rod 30 is a fitting 32 adapted for engagement with link 11 of the first connector 10. Fitting 32 extends into a clevis portion 32*a* which carries a clevis pin 33. Clevis pin 33 passes through bore 11*b* of link 11 of the first connector 10. At the other end of rod 31, the second fitting 35 is fastened to rod 31. Fitting 35 extends into a clevis portion 35*a* which carries a clevis pin 36. Clevis pin 36 passes through bore 21*b* of the link 21 of the second connector 20.

The second support 40 comprises a strap, as shown in FIG. 3, which passes around the outer surface of links 11 and 21 within the clevis portion 10*b* and 20*b*, respectively, of the first and second connectors 10 and 20. The length of strap 40 is such that when the system 10 is in place between the cryogen container and its surrounding vacuum jacket, as shown in FIG. 1, the second support is placed in tension as connectors 10 and 20 are drawn apart when the system is installed. The second member 40 is made of a material such as fiberglass-epoxy in the form of a band. Fiberglass-epoxy has low thermal conductance, particularly in the relatively narrow strap configuration, shown in FIGS. 2 and 3. It is designed to provide sufficient cross-sectional area to support a portion of the weight of the cryogen container and its contents under normal gravity.

Thus, when the cryogen container is carried within the vacuum jacket by a plurality of such supports, it will be suspended from its surrounding environment by the tension carried by the plurality of fiberglass-epoxy bands 40. Since the fiberglass-epoxy bands need only carry a portion of the weight of the container and its contents, the cross-sectional area and the area of contact with the container and the supporting structure may be substantially reduced, thereby reducing the heat transferred between the cryogen container and its surrounding environment by the support 6. Under such normal conditions, the length of the rigid, supporting structure 30, including its end fittings 32 and 35, is such that its clevis pins 33 and 36 are spaced within the bores 11*b* and 21*b*, respectively of the first connector 10 and the second connector 20; and the rigid first support 30 is thus free of contact with the first and second connector means 10 and 20, respectively. To help maintain the spacing between pins 33 and 36 of the first support 30 and the links 11 and 21, respectively, of the first and second connector means, spring-biasing means, such as springs 34 and 37, respectively, may be provided between the ends of the first support 30 and extending portions 11*c* and 21*c* of links 11 and 21, respectively. The extending portions of links 11*c* and 21*c* that may be engaged by spring-biasing means 34 and 37 may be materials having low thermal conductivity.

The second supporting member 40 may be provided with extending fins 41 to permit it to be connected with vapor-cooled shields to further reduce the heat loss over the second support 40 during orbital operation.

With a container 2 suspended from the warmer surrounding environment, wall 4 by a plurality of supporting systems 6 of this invention (See FIG. 1) and the spacecraft on ground awaiting launch, the weight of the cryogen container 2 and its contents will be carried by the plurality of tensile supports 40 of supporting systems of this invention. Likewise, with the spacecraft in orbit, the cryogen container 2 and its contents are supported separated from the surrounding environment by the plurality of tensile supports 40 of the supports of this invention.

During periods of launch, however, the supporting systems 6 operate in the following manner. (Refer to FIGS. 2 and 3.) If, for example, an acceleration force is imposed by the spacecraft structure upon such a system, this force will begin to stretch the tensile member 40. As tensile member 40 stretches in response to the increased forces it must bear, the annular spaces between pins 33 and 36 of the first support 30 and the bores **11*b* and 21*b* of links 11 and 21, respectively, of the first and second connector means 10 and 20 are reduced to zero; and links 11 and 21, respectively, are engaged by clevis pins 33 and 36; and all further forces tending to move the first connector means 10 away from the second connector means 20 are carried by the first support 30. Thus, during periods of acceleration imposing a high force tending to separate the first and second connector means 10 and 20, the force is carried by the first connector means 10 including fastening portion 10*a*, clevis portion 10*b*, clevis pin 12, link 11, clevis pin 33, fitting 32, bar 31, fitting 35, clevis pin 36, link 21, clevis pin 22, and the second connector means 20 including fastening portion 20*a* and clevis portion 20*b*. As the load on the system is reduced, the resilience of the second support 40 returns the supporting system 6** to its original and normal position.

The passive nature of this support system insures that it retains a high reliability. Clearance can be provided between the ends of first support 30 where they are adapted for engagement with the first and second connector means 10 and 20, respectively. These clearances are maintained as the system is installed.

While we have shown a particularly preferred embodiment, other embodiments may be devised without departing from the spirit and scope of the following claims.

We claim:

1. A system for maintaining the spacing of a cryogen container from surrounding vacuum jacket, comprising a first connector adapted to be fastened to the cryogenic container, a second connector adapted to be fastened to the vacuum jacket, a low conductance member extending between the first connector and the second connector, said low conductance member being maintained in tension between the first and second connector means and maintaining the spacing of one connector from the other in the presence of gravity and the absence of forces imposed by acceleration, a rigid member having high-tensile strength extending between the first and second connectors within the low conductance member, said rigid member being adapted at its ends to engage the first and second connectors and to prevent them from moving apart, but having such length between its ends that its ends do not contact the first and second connectors when the spacing of the first and second connectors is being maintained by the low conductance member, said low conductance member having such elasticity and resilience that when exposed to forces in excess of those represented by the container and its contents at normal gravity, the low conductance member will stretch and permit the ends of the rigid member to engage and hold the first and second connectors and maintain the spacing of the first and second connectors and that upon termination of such exposure, the resilience of the low conductance member will disengage the ends of the rigid member from the first and second connectors and return the first and second connectors to their normal spacing.

2. The system of claim 1 wherein the first and second connectors each include a fastening portion and a clevis portion, a pin carried by the clevis portion, and an engagement link on said pin intermediate the outer legs of the clevis portion and having a portion extending outwardly and forming a bore, said rigid member includes at each end a yoke forming a clevis with two legs that extend on each side of the extending portion of engagement link and that carry a pin that passes through a bore of the engagement link, the spacing between the legs being significantly greater than the width of the extending portion of the engagement link and the pin diameter being substantially smaller than the bore of the engagement link to thereby provide thermal isolation space between the engagement links of the first and second connectors and the ends of the rigid member in absence of forces imposed by acceleration, the imposition of acceleration resulting in the pins of the rigid member engaging the bore-forming walls of the engagement links of the first and second connectors.

3. The system of claim 2 wherein the low conductivity member is a band that passes about the outer surface of the engagement links of the first and second connectors, and springs extend between the engagement links of the first and second connectors and the ends of the rigid member to maintain both the engagement links of the first and second connectors in engagement with the low conductivity member, and the spacing of the first and second connectors and the maintenance of the thermal isolation spaces.

4. A spacer for cryogenic containers, comprising a rigid member including a clevis and a clevis pin at each end, a pair of connectors, one at each end of the rigid member, each connector including a link portion passing around the clevis pin at one end of the rigid member and forming an inner engagement surface and an outer engagement surface, each connector inner engagement surface having a shape and size such that a significant space may be maintained between the link and the clevis pin, a second member engaging the outer engagement surfaces of the pair of connectors and having such length that, when installed, the second member through tension holds a pair of connectors spaced one from the other so that the clevis pins and the inner engagement surfaces are free of contact, said second member, when exposed to forces significantly in excess of the forces imposed by gravity, being deformable by the increased tension sufficiently that the connector links engage the clevis pins of the rigid member and further force is carried by the rigid member, said deformation thereby being limited to about twice the space between the clevis pin and the link and below the elastic limit of the second member, said second member, upon termination of the exposure of forces in excess of those imposed by gravity, relaxing to again space the connectors so that the link and the clevis pins of the rigid member are free of contact.

5. A cryogen container support, comprising first connector means and second connector means, a first support extending between the first and second connector means, said first support being constructed of high-strength metal and being adapted at its ends for structural engagement and support of said first and second connector means, means between the first support and the first and second connector means at each end of the first support to urge their disengagement and provide a thermal isolation space between the first support and the first and second connector means, and a second support extending between said first and second connector means, said second support being constructed of material having low thermal conductivity and a degree of elasticity and providing support of said first connector means from said second connector means in the presence of normal forces imposed by the container and its contents, said second support being deformable in response to forces significantly in excess of the normal gravitational forces imposed by the container and its contents to permit the structural engagement of the first support with the first and second connection means.

* * * * *